US010351794B2

(12) United States Patent
Aoki et al.

(10) Patent No.: US 10,351,794 B2
(45) Date of Patent: Jul. 16, 2019

(54) LUBRICATING OIL COMPOSITION

(71) Applicant: IDEMITSU KOSAN CO., LTD., Chiyoda-ku (JP)

(72) Inventors: Shinji Aoki, Ichihara (JP); Tadashi Kisen, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/533,136

(22) PCT Filed: Aug. 12, 2015

(86) PCT No.: PCT/JP2015/072876
§ 371 (c)(1),
(2) Date: Jun. 5, 2017

(87) PCT Pub. No.: WO2016/092907
PCT Pub. Date: Jun. 16, 2016

(65) Prior Publication Data

US 2017/0335231 A1 Nov. 23, 2017

(30) Foreign Application Priority Data

Dec. 12, 2014 (JP) ..... 2014-252322

(51) Int. Cl.
*C10M 105/36* (2006.01)
*C10M 169/04* (2006.01)
*C10M 145/30* (2006.01)

(52) U.S. Cl.
CPC ..... *C10M 169/041* (2013.01); *C10M 105/36* (2013.01); *C10M 145/30* (2013.01); *C10M 2207/0406* (2013.01); *C10M 2207/2825* (2013.01); *C10M 2207/2845* (2013.01); *C10M 2207/2855* (2013.01); *C10M 2209/084* (2013.01); *C10M 2209/103* (2013.01); *C10M 2209/105* (2013.01); *C10M 2209/1033* (2013.01); *C10M 2209/1045* (2013.01); *C10N 2230/00* (2013.01); *C10N 2230/02* (2013.01); *C10N 2230/68* (2013.01); *C10N 2240/02* (2013.01); *C10N 2240/04* (2013.01); *C10N 2240/08* (2013.01)

(58) Field of Classification Search
CPC ..... C10M 2209/103
USPC ..... 508/579, 501, 478
See application file for complete search history.

(56) References Cited

U.S. PATENT DOCUMENTS 6,362,140 B1 * 3/2002 McGraw ..... C08G 18/10 508/579
6,436,883 B1 * 8/2002 Nieh ..... C10M 107/34 508/539
6,841,522 B2 * 1/2005 Corner ..... C10M 111/02 508/495
8,394,749 B2 * 3/2013 Aoyama ..... C10M 105/02 208/18
8,586,520 B2 * 11/2013 Habeeb ..... C10M 169/04 508/469
8,969,271 B2 * 3/2015 Greaves ..... C10M 107/34 508/579
2003/0109389 A1 * 6/2003 Wardlow ..... C10M 111/04 508/482
2006/0217274 A1 * 9/2006 Brown ..... C10M 129/76 508/293
2008/0176775 A1 7/2008 Wright et al.
2010/0113314 A1 * 5/2010 Okada ..... C10M 141/08 508/443
2010/0130394 A1 * 5/2010 Tsubouchi ..... C10M 105/34 508/478
2014/0256607 A1 * 9/2014 Tamoto ..... C10M 107/00 508/494
2015/0057203 A1 * 2/2015 Tsubouchi ..... C10M 169/041 508/482

FOREIGN PATENT DOCUMENTS

DE 2 246 598 A1 4/1973
JP 6-200277 A * 7/1994
JP 2013-199549 A 10/2013
WO 2008/133233 A1 11/2008
WO 2010/005022 A1 1/2010

OTHER PUBLICATIONS

International Search Report dated Oct. 6, 2015 in PCT/JP2015/072876 filed Aug. 12, 2015.
Extended European Search Report dated Apr. 26, 2018 in European Patent Application No. 15868319.3, 7 pages.

* cited by examiner

*Primary Examiner* — Ellen M McAvoy
(74) *Attorney, Agent, or Firm* — Oblon, McClelland, Maier & Neustadt, L.L.P.

(57) ABSTRACT

A lubricating oil composition prepared by blending a base oil (A) containing a compound (A1) that is an ester or ether and has two or more aromatic rings, with a polyalkylene glycol (B) is provided. The lubricating oil composition has a high density (i.e., a high bulk modulus), a high viscosity index, and excellent shear stability.

15 Claims, No Drawings

LUBRICATING OIL COMPOSITION

CROSS-REFERENCE TO RELATED APPLICATIONS

This application is a National Stage of PCT/JP2015/072876, which was filed on Aug. 12, 2015. This application is based upon and claims the benefit of priority to Japanese Application No. 2014-252322, which was filed on Dec. 12, 2014.

TECHNICAL FIELD

The present invention relates to a lubricating oil composition.

BACKGROUND ART

Various lubricating oils have been used as a hydraulic oil, for example, for various hydraulic apparatuses such as a construction machine, an injection molding machine, a pressing machine, a crane, a machining center, and the like. An ordinary lubricating oil has a bulk modulus that is not so high, and thus has a problem that it is difficult to exhibit sufficiently the function as a pressure transmission medium thereof. Accordingly, a lubricating oil having a high bulk modulus, which is capable of being favorably used as a hydraulic oil, has been demanded. There is a correlation between the bulk modulus and the density of a lubricating oil, and a lubricating oil having a higher density can be expected to have a higher bulk modulus.

For example, PTLs 1 and 2 propose, as a hydraulic oil having a high bulk modulus, a hydraulic oil containing an ester or ether having two or more aromatic rings as a base oil.

However, the hydraulic oils described in PTLs 1 and 2 have a high bulk modulus, but have a low viscosity index, have room for improvement in the capability as a lubricating oil, and have insufficient balance between the capability as a pressure transmission medium and the capability as a lubricating oil.

In view of the problem, for example, PTL 3 describes a lubricating oil composition prepared by blending a base oil containing an ester, an ether, or the like having two or more aromatic rings, with a poly(meth)acrylate having a mass average molecular weight of 50,000 or less, which is intended to provide a lubricating oil composition having a high density (i.e., a high bulk modulus) and a high viscosity index.

CITATION LIST

Patent Literatures

PTL 1: WO 2008/133233
PTL 2: WO 2010/005022
PTL 3: JP 2013-199549 A

SUMMARY OF INVENTION

Technical Problem

However, the present inventors studied the lubricating oil composition described in PTL 3, and have found that the lubricating oil composition described in PTL 3 has a relatively high bulk modulus and a relatively high viscosity index, but has a risk of temporary or permanent decrease of the viscosity due to the shear action applied in the use thereof, and thus has further room for improvement in the shear stability.

The present invention has been made in view of the aforementioned problem, and an object thereof is to provide a lubricating oil composition that has a high density (i.e., a high bulk modulus), a high viscosity index, and excellent shear stability.

Solution to Problem

The present inventors have found that the aforementioned problem can be solved by a lubricating oil composition prepared by blending a base oil containing a particular ester or ether with a polyalkylene glycol, and thus the present invention has been completed.

The present invention provides a lubricating oil composition shown by the following item [1].

[1] A lubricating oil composition prepared by blending a base oil (A) containing a compound (A1) that is an ester or ether and has two or more aromatic rings, with a polyalkylene glycol (B).

Advantageous Effects of Invention

The lubricating oil composition of the present invention has a high density (i.e., a high bulk modulus), a high viscosity index, and excellent shear stability. Accordingly, the viscosity reduction of the lubricating oil composition of the present invention, due to the shear action in the use thereof is reduced, and the lubricating oil composition of the present invention can exhibits an excellent performance for a prolonged period of time.

DESCRIPTION OF EMBODIMENTS

In the description herein, the number average molecular weight (Mn) is a value that is measured by the GPC (gel permeation chromatography) method as the standard polystyrene conversion, and is specifically a value that is measured by the method described in the examples.

In the description herein, the kinematic viscosity at 40° C. or 100° C. and the viscosity index are values that are measured according to JIS K2283:2000 (ASTM D445).

In the description herein, the density at 15° C. is a value that is measured according to JIS K2249-1:2011.

In the description herein, for example, the term "(poly) oxyalkylene group" is a term that designates both "oxyalkylene group" and "polyoxyalkylene group", and the other similar terms are the same.

Lubricating Oil Composition

The lubricating oil composition of the present invention is a lubricating oil composition prepared by blending a base oil (A) containing a compound (A1) that is an ester or ether and has two or more aromatic rings, with a polyalkylene glycol (B).

In the description herein, the definition that "a lubricating oil composition prepared by blending a component (A) with a component (B)" is a comprehensive definition that encompasses not only "a lubricating oil composition containing a component (A) and a component (B)", but also "a lubricating oil composition containing a modified product obtained through modification of at least one of a component (A) and a component (B)" and "a lubricating oil composition containing a reaction product obtained through reaction of a component (A) and a component (B)".

In the case where an aromatic ester or ether, which is a base oil having a high bulk modulus (i.e., a high bulk modulus oil), is used in a lubricating oil composition used in general hydraulic equipments, a poly(meth)acrylate or the like is generally blended as a viscosity index improver for retaining a sufficient viscosity index of a lubricating oil (see, for example, PTL 3).

However, the present inventors studied a lubricating oil composition containing a poly(meth)acrylate, and have found that the viscosity of the lubricating oil composition containing a poly(meth)acrylate tends to decrease due to the shear action applied in the use thereof, and thus the shear stability of the lubricating oil composition tends to decrease.

Under the circumstances, the present inventors have found that a lubricating oil composition that has a high density (i.e., a high bulk modulus) and a high viscosity index and also has excellent shear stability can be obtained by blending a base oil (A) containing a compound (A1) that is an ester or ether and has two or more aromatic rings with a polyalkylene glycol (B) as a viscosity index improver, and thus the present invention has been completed.

In the lubricating oil composition according to one embodiment of the present invention, the base oil (A) may contain a base oil other than the compound (A1), in addition to the compound (A1). The base oil other than the compound (A1) is preferably a compound (A2) that is an ester or ether and has no aromatic ring.

The lubricating oil composition according to one embodiment of the present invention may contain a general additive for a lubricating oil, in addition to the base oil (A) and the polyalkylene glycol (B).

In the lubricating oil composition according to one embodiment of the present invention, the total content of the base oil (A) and the polyalkylene glycol (B) is preferably from 70 to 100% by mass, more preferably from 80 to 100% by mass, further preferably from 90 to 100% by mass, and still further preferably from 95 to 100% by mass, based on the total amount (100% by mass) of the lubricating oil composition.

The components constituting the lubricating oil composition according to one embodiment of the present invention will be described below.

Base Oil (A)

The base oil (A) used in the lubricating oil composition of the present invention contains a compound (A1) that is an ester or ether and has two or more aromatic rings.

The base oil (A) used in one embodiment of the present invention preferably contains a compound (A2) that is an ester or ether and has no aromatic ring, in addition to the compound (A1), from the standpoint of the control of the viscosity of the resulting lubricating oil composition and the enhancement of the viscosity index thereof.

The base oil (A) used in one embodiment of the present invention may contain a synthetic oil that does not correspond to the compounds (A1) and (A2) in such a range that does not impair the effect of the present invention.

The total content of the compound (A1) and the compound (A2) contained in the base oil (A) used in one embodiment of the present invention is preferably from 70 to 100% by mass, more preferably from 80 to 100% by mass, further preferably from 90 to 100% by mass, and still further preferably from 95 to 100% by mass, based on the total amount (100% by mass) of the base oil (A).

The content of the base oil (A) used in the lubricating oil composition according to one embodiment of the present invention is preferably 60% by mass or more, more preferably 70% by mass or more, further preferably 80% by mass or more, and still further preferably 90% by mass or more, and is preferably 99.8% by mass or less, more preferably 99.0% by mass or less, further preferably 95% by mass or less, and still further preferably 90% by mass or less, based on the total amount (100% by mass) of the lubricating oil composition, from the standpoint of providing a lubricating oil composition having a high density (i.e., a high bulk modulus).

The kinematic viscosity at 40° C. of the base oil (A) used in one embodiment of the present invention is preferably from 1 to 100 $mm^2/s$, more preferably from 5 to 80 $mm^2/s$, and further preferably from 10 to 50 $mm^2/s$, from the standpoint of providing a lubricating oil composition having an appropriate kinematic viscosity.

The viscosity index of the base oil (A) used in one embodiment of the present invention is preferably 80 or more, and more preferably 95 or more, from the same standpoint as above.

The compound (A1) and the compound (A2) contained in the base oil (A) used in one embodiment of the present invention will be described below.

Compound (A1)

As the compound (A1) contained as the base oil (A) in the lubricating oil composition of the present invention, any compound that is an ester or ether and has two or more aromatic rings can be used.

The compound (A1) used in one embodiment of the present invention may be used alone or as a combination of two or more kinds thereof.

Examples of the aromatic ring of the compound (A1) include a benzene ring, a naphthalene ring, an anthracene ring, a biphenyl ring, an azulene ring, a phenanthrene ring, a pyrene ring, a chrysene ring, a terphenylene ring, an o-terphenyl ring, a m-terphenyl ring, a p-terphenyl ring, an acenaphthene ring, a coronene ring, a fluorene ring, a fluoranthene ring, a naphthacene ring, a pentacene ring, a perylene ring, a pentaphene ring, a picene ring, a pyrene ring, a pyranthrene ring, and an anthanthrene ring.

Among these, a benzene ring and a naphthalene ring are preferred, and a benzene ring is more preferred.

Examples of the compound (A1) include an ester or ether that has two or more benzene rings, such as "an ester or ether that has two or more phenyl groups", and an ester or ether that has one or more polycyclic aromatic hydrocarbon group, such as "an ester or ether that has one or more naphthyl group".

The compound (A1) used in one embodiment of the present invention is preferably an ester or ether that has an aromatic ring at at least one end of one molecule, and more preferably an ester or ether that has aromatic rings at both ends of one molecule, from the standpoint of providing a lubricating oil composition having a high density (i.e., a high bulk modulus).

More specifically, the compound (A1) is preferably a compound represented by the following general formula (a11).

(a11)

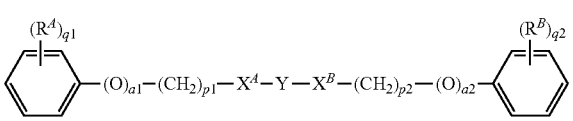

In the formula (a11), $R^A$ and $R^B$ each independently represent an alkyl group having from 1 to 30 carbon atoms, a cycloalkyl group having from 3 to 12 ring carbon atoms, an aryl group having from 6 to 12 ring carbon atoms, an alkyloxycarbonyl group having from 2 to 30 carbon atoms, or an alkylcarbonyloxy group having from 2 to 30 carbon atoms. Among these, $R^A$ and $R^B$ each preferably independently represent an alkyl group having from 1 to 30 carbon atoms.

$X^A$ and $X^B$ each independently represent a single bond, —O—, —C(=O)—, —C(=O)—O—, or —O—C(=O)—, provided that $X^A$ and $X^B$ do not simultaneously represent single bonds.

Y represents an alkylene group or a (poly)oxyalkylene group, and preferably a (poly)oxyalkylene group.

a1 and a2 each independently represent 0 or 1, and preferably 0. In the case where a1 and a2 are 0, single bonds are provided. Specifically, in the case where a1 is 0, the carbon atom of the left side benzene ring and $—(CH_2)_{p1}—$ are directly bonded to each other in the formula (a11), and in the case where a2 is 0, the carbon atom of the right side benzene ring and $—(CH_2)_{p2}—$ are directly bonded to each other in the formula (a11).

p1 and p2 each independently represent an integer of from 0 to 3, preferably 0 or 1, and more preferably 0. In the case where p1 and p2 are 0, single bonds are provided. Specifically, in the case where p1 is 0, $—(O)_{a1}—$ and $—X^A—$ are directly bonded to each other in the formula (a11), and in the case where p2 is 0, $—(O)_{a2}—$ and $—X^B—$ are directly bonded to each other in the formula (a11).

q1 and q2 each independently represent an integer of from 0 to 5, preferably an integer of from 0 to 3, more preferably 0 or 1, and further preferably 0.

The case where q1 and q2 are 0 means that the benzene rings in the formula (a11) are unsubstituted, respectively.

Examples of the alkyl group that can be selected for $R^A$ and $R^B$ include a methyl group, an ethyl group, a n-propyl group, an isopropyl group, a n-butyl group, an isobutyl group, a s-butyl group, a t-butyl group, a pentyl group (including the isomers), a hexyl group (including the isomers), a heptyl group (including the isomers), an octyl group (including the isomers), a nonyl group (including the isomers), and a decyl group (including the isomers).

The alkyl group may be a linear alkyl group or may be a branched alkyl group.

The number of carbon atoms of the alkyl group is preferably from 1 to 10, more preferably from 1 to 6, and further preferably from 1 to 3.

Examples of the cycloalkyl group that can be selected for $R^A$ and $R^B$ include a cyclopropyl group, a cyclobutyl group, a cyclopentyl group, a cyclohexyl group, a cycloheptyl group, a cyclooctyl group, and an adamantyl group.

The number of ring carbon atoms of the cycloalkyl group is preferably from 3 to 6, and more preferably 5 or 6.

Examples of the aryl group that can be selected for $R^A$ and $R^B$ include a phenyl group, a biphenyl group, a naphthyl group, and an anthracenyl group.

The number of ring carbon atoms of the aryl group is preferably from 6 to 10, and more preferably 6.

Examples of the alkyloxycarbonyl group that can be selected for $R^A$ and $R^B$ include a monovalent group containing an oxycarbonyl group (—O—C(=O)—) and the aforementioned alkyl group that is bonded to the oxygen atom bonded to the carbonyl group in the oxycarbonyl group, such as a methoxycarbonyl group and an ethoxycarbonyl group.

The number of carbon atoms of the alkyloxycarbonyl group is preferably from 2 to 16, more preferably from 2 to 10, and further preferably from 2 to 5.

Examples of the alkylcarbonyloxy group that can be selected for $R^A$ and $R^B$ include a monovalent group containing a carbonyloxy group (—C(=O)—O—) and the aforementioned alkyl group that is bonded to the carbon atom in the carbonyloxy group, such as a methylcarbonyloxy group and an ethylcarbonyloxy group.

The number of carbon atoms of the alkylcarbonyloxy group is preferably from 2 to 16, more preferably from 2 to 10, and further preferably from 2 to 5.

Examples of the alkylene group that can be selected for Y include a methylene group, an ethylene group, a n-propylene group, an isopropylene group, a n-butylene group, an isobutylene group, a n-pentylene group, a n-hexylene group, a n-heptylene group, a n-octylene group, a n-nonylene group, a n-decylene group, a n-dodecylene group, and a n-hexadecylene group.

The alkylene group may be linear or branched.

The number of carbon atoms of the alkylene group is preferably from 1 to 50, more preferably from 2 to 40, further preferably from 3 to 30, and still further preferably from 4 to 20.

Examples of the (poly)oxyalkylene group that can be selected for Y include a (poly)oxymethylene group, a (poly)oxyethylene group, a (poly)oxypropylene group, a (poly)oxyisopropylene group, a (poly)oxybutylene group, a (poly)oxyisobutylene group, and a (poly)oxypentylene group.

The (poly)oxyalkylene group may be linear or branched.

Among these, a (poly)oxyethylene group, a (poly)oxypropylene group, and a (poly)oxyisopropylene group are preferred, and a (poly)oxyethylene group is more preferred.

The number of carbon atoms of the (poly)oxyalkylene group may be appropriately determined corresponding to the value of the number average molecular weight of the compound represented by the general formula (a11).

In one embodiment of the present invention, the compound (A1) is more preferably a compound represented by the following general formula (a12), and further preferably a compound represented by the following general formula (a13), from the standpoint of providing a lubricating oil composition having a high density (i.e., a high bulk modulus).

(a12)

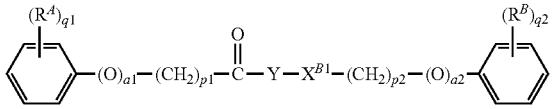

In the formula (a12), $R^A$, $R^B$, a1, a2, p1, p2, q1, q2, and Y are the same as those defined in the descriptions relating to the general formula (a11), and the preferred groups (including the preferred ranges of the number of carbon atoms of the groups) and the preferred numerical ranges thereof are also the same.

$X^{B1}$ represents a single bond, —O—, or —O—C(=O)—, and preferably a single bond or —O—C(=O)—.

(a13)

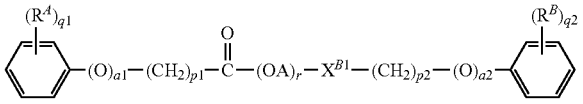

In the formula (a13), $R^A$, $R^B$, a1, a2, p1, p2, q1, and q2, are the same as those defined in the descriptions relating to the general formula (a11), and the preferred groups (including the preferred ranges of the number of carbon atoms of the groups) and the preferred numerical ranges thereof are also the same.

$X^{B1}$ represents a single bond, —O—, or —O—C(=O)—, and preferably a single bond or —O—C(=O)—.

A represents an alkylene group having from 2 to 4 carbon atoms, and examples thereof include an ethylene group (—$CH_2CH_2$—), an ethylidene group (—$CH(CH_3)$—), a trimethylene group (—$CH_2CH_2CH_2$—), a propylene group (—$CH(CH_3)CH_2$—), a propylidene group (—$CHCH_2CH_3$—), an isopropylidene group (—$C(CH_3)_2$—), a tetramethylene group (—$CH_2CH_2CH_2CH_2$—), a 1-methyltrimethylene group (—$CH(CH_3)CH_2CH_2$—), a 2-methyltrimethylene group (—$CH_2CH(CH_3)CH_2$—), and a butylene group (—$C(CH_3)_2CH_2$—). Among these, A preferably represents an ethylene group or a propylene group, and more preferably an ethylene group.

r is an average value of the number of the oxyalkylene unit (i.e., the unit represented by "(OA)" in the formula (a13)), and represents a number of 1 or more. The value of r may be appropriately determined corresponding to the value of the number average molecular weight of the compound represented by the general formula (a13).

In the case where two or more kinds of different compounds each represented by the general formula (a13) are used, the value of r is an average value (weighted average value), and it suffices that the average value is 1 or more.

The number average molecular weight (Mn) of the compound (A1) used in one embodiment of the present invention is preferably from 100 to 5,000, more preferably from 150 to 3,000, further preferably from 200 to 1,500, and still further preferably from 250 to 1,000.

The kinematic viscosity at 40° C. of the compound (A1) used in one embodiment of the present invention is preferably from 5 to 80 $mm^2/s$, more preferably from 10 to 60 $mm^2/s$, and further preferably from 15 to 50 $mm^2/s$, from the standpoint of providing a lubricating oil composition having an appropriate kinematic viscosity and a high viscosity index.

The viscosity index of the compound (A1) used in one embodiment of the present invention is preferably 50 or more, more preferably 60 or more, and further preferably 65 or more, from the same standpoint as above.

The density at 15° C. of the compound (A1) used in one embodiment of the present invention is preferably 1.100 $g/cm^3$ or more, more preferably 1.105 $g/cm^3$ or more, and further preferably 1.110 $g/cm^3$ or more, and is generally 1.250 $g/cm^3$ or less, from the standpoint of providing a lubricating oil composition having a high density (i.e., a high bulk modulus).

The content of the compound (A1) in the base oil (A) used in one embodiment of the present invention is preferably 30% by mass or more, more preferably 40% by mass or more, further preferably 50% by mass or more, and still further preferably 60% by mass or more, and is preferably 100% by mass or less, more preferably 95% by mass or less, further preferably 90% by mass or less, and still further preferably 85% by mass or less, based on the total amount (100% by mass) of the base oil (A), from the standpoint of providing a lubricating oil composition having a high density (i.e., a high bulk modulus).

The blending amount of the compound (A1) in the lubricating oil composition of one embodiment of the present invention is preferably 30% by mass or more, more preferably 40% by mass or more, further preferably 50% by mass or more, and still further preferably 60% by mass or more, based on the total amount (100% by mass) of the lubricating oil composition, from the standpoint of providing a lubricating oil composition having a high density (i.e., a high bulk modulus).

The blending amount of the compound (A1) in the lubricating oil composition of one embodiment of the present invention is preferably 99.8% by mass or less, more preferably 95% by mass or less, and further preferably 90% by mass or less, based on the total amount (100% by mass) of the lubricating oil composition, from the standpoint of providing a lubricating oil composition having an appropriately kinematic viscosity and the standpoint of ensuring the sufficient amount of the component (B), thereby providing a lubricating oil composition having excellent shear stability.

Compound (A2)

The base oil (A) used in one embodiment of the present invention preferably contains a compound (A2) that is an ester or ether and has no aromatic ring, in addition to the compound (A1), from the standpoint of the control of the viscosity of the resulting lubricating oil composition to an appropriate range and the enhancement of the viscosity index of the lubricating oil composition.

The compound (A2) used in one embodiment of the present invention may be used alone or as a combination of two or more kinds thereof.

Examples of the compound (A2) include a dicarboxylate ester or an ether of an ethylene glycol ether or a polyethylene glycol ether, and specifically include an adipate diester, such as an adipate diester of ethylene glycol monobutyl ether and an adipate diester of diethylene glycol monobutyl ether, a 2-ethylhexanoate diester of triethylene glycol, dibutyl sebacate, dioctyl adipate, dioctyl azelate, dioctyl sebacate, tetraethylene glycol dimethyl ether, and diethyl succinate.

Among these, a dicarboxylate ester of an ethylene glycol ether or a polyethylene glycol ether is preferred, and an adipate diester is more preferred, from the standpoint of the enhancement of the viscosity index of the resulting lubricating oil composition.

The kinematic viscosity at 40° C. of the compound (A2) used in one embodiment of the present invention is preferably from 1 to 30 $mm^2/s$, more preferably from 1 to 20 $mm^2/s$, and further preferably from 1 to 15 $mm^2/s$, from the standpoint of the control of the viscosity of the resulting lubricating oil composition to an appropriate range and the standpoint of the enhancement of the viscosity index of the lubricating oil composition.

The viscosity index of the compound (A2) used in one embodiment of the present invention is preferably 80 or more, more preferably 100 or more, and further preferably 120 or more, from the same standpoint as above.

The density at 15° C. of the compound (A2) used in one embodiment of the present invention is preferably 0.900 $g/cm^3$ or more, more preferably 0.950 $g/cm^3$ or more, and further preferably 1.000 $g/cm^3$ or more, and is generally 1.100 $g/cm^3$ or less, from the standpoint of providing a lubricating oil composition having a high density (i.e., a high bulk modulus).

The content ratio ((A1)/(A2)) of the compound (A1) and the compound (A2) contained in the base oil (A) used in one embodiment of the present invention is preferably from 1/1 to 10/1, more preferably 1.2/1 to 8.5/1, further preferably from 1.5/1 to 7/1, and still further preferably from 1.7/1 to 5.5/1, in terms of mass ratio.

In the case where the content ratio is in the range, a lubricating oil composition having a high density (i.e., a high bulk modulus) can be obtained while controlling the viscosity thereof and enhancing the viscosity index thereof.

The content of the compound (A2) in the base oil (A) used in one embodiment of the present invention is preferably 5% by mass or more, more preferably 7% by mass or more, further preferably 10% by mass or more, and still further preferably 15% by mass or more, and is preferably 70% by mass or less, more preferably 60% by mass or less, further preferably 50% by mass or less, and still further preferably 40% by mass or less, based on the total amount (100% by mass) of the base oil (A), from the same standpoint as above.

The blending amount of the compound (A2) in the lubricating oil composition of one embodiment of the present invention is preferably 3% by mass or more, more preferably 5% by mass or more, further preferably 10% by mass or more, and still further preferably 15% by mass or more, and is preferably 70% by mass or less, more preferably 60% by mass or less, further preferably 50% by mass or less, and still further preferably 40% by mass or less, based on the total amount (100% by mass) of the lubricating oil composition, from the same standpoint as above.

Synthetic Oil Other than Compounds (A1) and (A2)

The base oil (A) used in one embodiment of the present invention may contain a synthetic oil other than the compounds (A1) and (A2) in such a range that does not impair the effect of the present invention. In other words, the base oil (A) used in one embodiment of the present invention may be constituted by three or more kinds of synthetic oils.

Examples of the synthetic oil include a poly-α-olefin, such as polybutene and an α-olefin homopolymer or copolymer (for example, a homopolymer or copolymer of an α-olefin having from 8 to 14 carbon atoms, such as an ethylene-α-olefin copolymer); an alkylbenzene; an alkylnaphthalene; and a synthetic oil obtained through isomerization of wax produced by the Fischer-Tropsch method or the like (GTL wax).

Polyalkylene Glycol (B)

Examples of the polyalkylene glycol (B) used in the present invention include a polymer obtained through polymerization or copolymerization of an alkylene oxide.

The polyalkylene glycol (B) used in one embodiment of the present invention may be used alone or as a combination of two or more kinds thereof.

In the case where the polyalkylene glycol (B) is a copolymer, the form of copolymerization thereof is not particularly limited, and may be any of a block copolymer, a random copolymer, a graft copolymer, and the like.

Among these, the polyalkylene glycol (B) is preferably a compound represented by the following general formula (b1) from the standpoint of providing a lubricating oil composition having enhanced shear stability while retaining the high density (i.e., the high bulk modulus) and the high viscosity index thereof.

$$R^1—((OR^2)_a—OR^3)_b \quad (b1)$$

In the general formula (b1), $R^1$ represents a hydrogen atom, a monovalent hydrocarbon group having from 1 to 10 carbon atoms, an acyl group having from 2 to 10 carbon atoms, a divalent to hexavalent hydrocarbon group having from 1 to 10 carbon atoms, or a monovalent to hexavalent heterocyclic group having from 3 to 10 ring atoms.

$R^2$ represents an alkylene group having from 2 to 4 carbon atoms.

$R^3$ represents a hydrogen atom, a monovalent hydrocarbon group having from 1 to 10 carbon atoms, an acyl group having from 2 to 10 carbon atoms, or a monovalent heterocyclic group having from 3 to 10 ring atoms.

b represents an integer of from 1 to 6, and is preferably an integer of from 1 to 4, more preferably 2 or 3, and further preferably 3, from the standpoint of providing a lubricating oil composition having enhanced shear stability while retaining the high density (i.e., the high bulk modulus) and the high viscosity index thereof.

b is determined corresponding to the number of the bonding site to $R^1$ in the general formula (b1), i.e., the valence number of $R^1$. For example, in the case where $R^1$ represents a monovalent hydrocarbon group, such as an alkyl group or a cycloalkyl group, an acyl group, or a monovalent heterocyclic group, b is 1. In the case where $R^1$ represents a hydrocarbon group or a heterocyclic group, and the valence number of the group is 2, 3, 4, 5, or 6, b is 2, 3, 4, 5, or 6, respectively.

a is an average value of the number of the oxyalkylene unit, and represents a number of 1 or more. The value of a may be appropriately determined corresponding to the value of the number average molecular weight of the compound represented by the general formula (b1).

In the case where two or more kinds of different compounds each represented by the general formula (b1) are used, the value of a is an average value (weighted average value), and it suffices that the average value is 1 or more.

In the case where plural groups are present for each of $R^2$ and $R^3$, the plural groups for each of $R^2$ and $R^3$ may be the same as or different from each other.

Examples of the monovalent hydrocarbon group that can be selected for $R^1$ and $R^3$ include an alkyl group, such as a methyl group, an ethyl group, a n-propyl group, an isopropyl group, a n-butyl group, an isobutyl group, a sec-butyl group, a tert-butyl group, various pentyl groups, various hexyl groups, various heptyl groups, various octyl groups, various nonyl groups, and various decyl groups; a cycloalkyl group, such as a cyclopentyl group, a cyclohexyl group, various methylcyclohexyl groups, various ethylcyclohexyl groups, various propylcyclohexyl groups, and various dimethylcyclohexyl groups; an aryl group, such as a phenyl group, various methylphenyl groups, various ethylphenyl groups, various dimethylphenyl groups, various propylphenyl groups, various trimethylphenyl groups, various butylphenyl groups, and various naphthyl groups; and an arylalkyl group, such as a benzyl group, various phenylethyl groups, various methylbenzyl groups, various phenylpropyl groups, and various phenylbutyl groups.

The aforementioned alkyl groups each may be linear or branched.

The number of carbon atoms of the monovalent hydrocarbon group is preferably from 1 to 10, more preferably from 1 to 6, and further preferably from 1 to 3.

The hydrocarbon group moiety of the acyl group having from 2 to 10 carbon atoms that can be selected for $R^1$ and $R^3$ may be any of linear, branched, and cyclic. Examples of the hydrocarbon group moiety include the aforementioned monovalent hydrocarbon groups that can be selected for $R^1$ and $R^3$ that have from 1 to 9 carbon atoms.

The number of carbon atoms of the acyl group is preferably from 2 to 10, and more preferably from 2 to 6.

Examples of the divalent to hexavalent hydrocarbon group that can be selected for $R^1$ include divalent to hexavalent residual groups obtained by further removing from 1 to 5 hydrogen atoms from the monovalent hydrocarbon groups that can be selected for $R^1$, and residual groups obtained by removing hydroxyl groups from a polyhydric alcohol, such as trimethylolpropane, glycerin, pentaerythritol, sorbitol, 1,2,3-trihydroxycyclohexane, and 1,3,5-trihydroxycyclohexane.

The number of carbon atoms of the divalent to hexavalent hydrocarbon group is preferably from 1 to 10, more preferably from 1 to 6, and further preferably from 1 to 3.

The heterocyclic group that can be selected for $R^1$ and $R^3$ is preferably an oxygen atom-containing heterocyclic group or a sulfur atom-containing heterocyclic group. The heterocyclic group may be saturated or unsaturated.

Examples of the oxygen atom-containing heterocyclic group include monovalent to hexavalent residual groups obtained by removing from 1 to 6 hydrogen atoms from an oxygen atom-containing saturated heterocyclic ring, such as 1,3-propylene oxide, tetrahydrofuran, tetrahydropyran, and hexamethylene oxide, and an oxygen atom-containing unsaturated heterocyclic ring, such as acetylene oxide, furan, pyran, oxycycloheptatriene, isobenzofuran, and isochromene.

Examples of the sulfur atom-containing heterocyclic group include monovalent to hexavalent residual groups obtained by removing from 1 to 6 hydrogen atoms from a sulfur atom-containing saturated heterocyclic ring, such as ethylene sulfide, trimethylene sulfide, tetrahydrothiophene, tetrahydrothiopyran, and hexamethylene sulfide, and a sulfur atom-containing unsaturated heterocyclic ring, such as acetylene sulfide, thiophene, thiapyran, and thioterpyridine.

The number of ring atoms of the heterocyclic group is preferably from 3 to 10, more preferably from 3 to 6, and further preferably 5 or 6.

$R^1$ is preferably a monovalent to hexavalent (preferably monovalent to tetravalent, more preferably divalent or trivalent, and further preferably trivalent) hydrocarbon group or a monovalent to hexavalent (preferably monovalent to tetravalent, more preferably divalent or trivalent, and further preferably trivalent) heterocyclic group, and more preferably a monovalent to hexavalent (preferably monovalent to tetravalent, more preferably divalent or trivalent, and further preferably trivalent) hydrocarbon group.

$R^3$ is preferably a hydrogen atom, a monovalent hydrocarbon group, or a monovalent heterocyclic group, and more preferably a hydrogen atom or a monovalent hydrocarbon group.

Examples of the alkylene group that can be selected for $R^2$ include an alkylene group having 2 carbon atoms, such as an ethylene group ($—CH_2CH_2—$) and an ethylidene group ($—CH(CH_3)—$); an alkylene group having 3 carbon atoms, such as a trimethylene group ($—CH_2CH_2CH_2—$), a propylene group ($—CH(CH_3)CH_2—$), a propylidene group ($—CHCH_2CH_3—$), and an isopropylidene group ($—C(CH_3)_2—$); and an alkylene group having 4 carbon atoms, such as a tetramethylene group ($—CH_2CH_2CH_2CH_2—$), a 1-methyltrimethylene group ($—CH(CH_3)CH_2CH_2—$), a 2-methyltrimethylene group ($—CH_2CH(CH_3)CH_2—$), and a butylene group ($—C(CH_3)_2CH_2—$).

In the case where plural groups are present for $R^2$, the plural groups for $R^2$ may be the same as each other or may be a combination of two or more kinds of alkylene groups.

Among these, $R^2$ is preferably a propylene group ($—CH(CH_3)CH_2—$).

In the compound represented by the general formula (b1), the content of the oxypropylene unit ($—OCH(CH_3)CH_2—$) is preferably from 50 to 100% by mol, more preferably from 65 to 100% by mol, and further preferably from 80 to 100% by mol, based on the total amount (100% by mol) of the oxyalkylene unit ($OR^2$) in the structure of the compound.

The number average molecular weight (Mn) of the polyalkylene glycol (B) used in one embodiment of the present invention is preferably from 1,000 to 60,000, more preferably from 2,500 to 40,000, further preferably from 5,000 to 30,000, and still further preferably from 10,000 to 20,000, from the standpoint of the enhancement of the viscosity index of the lubricating oil composition and of providing a lubricating oil composition having excellent shear stability.

The viscosity at 25° C. of the polyalkylene glycol (B) used in one embodiment of the present invention is preferably from 1,000 to 60,000 mPa·s more preferably from 2,000 to 50,000 mPa·s, further preferably from 3,500 to 40,000 mPa·s, and still further preferably from 5,000 to 30,000 mPa·s, from the same standpoint as above.

In the description herein, the viscosity at 25° C. is a value that is measured according to JIS K7117-1:1999.

The content of the polyalkylene glycol (B) in the lubricating oil composition of one embodiment of the present invention is preferably from 0.2 to 15% by mass, more preferably from 0.5 to 12% by mass, further preferably from 1.0 to 10% by mass, and still further preferably from 2.0 to 8.0% by mass, based on the total amount (100% by mass) of the lubricating oil composition, from the standpoint of the enhancement of the viscosity index of the lubricating oil composition and of providing a lubricating oil composition having excellent shear stability.

Additive for Lubricating Oil

The lubricating oil composition of one embodiment of the present invention may have blended therein an additive for a lubricating oil that is used in general lubricating oils, in addition to the base oil (A) and the polyalkylene glycol (B) as long as the problem of the present invention is solved.

Examples of the additive for a lubricating oil include an antioxidant, a detergent-dispersant, a metal deactivator, a pour-point depressant, an anti-wear agent, a defoaming agent, an extreme pressure agent, and a viscosity index improver other than the polyalkylene glycol (B). The additives may be used alone or as a combination of two or more kinds thereof.

Examples of the viscosity index improver other than the polyalkylene glycol (B) include a polymethacrylate, a polyethyl methacrylate, an olefin copolymer (such as an ethylene-propylene copolymer), and a styrene copolymer (such as a styrene-diene copolymer and a styrene-isoprene copolymer).

The number average molecular weight (Mn) of the viscosity index improver is generally from 1,000 to 300,000.

In one embodiment of the present invention, the blending amount of the viscosity index improver other than the polyalkylene glycol (B) (in terms of resin content) is preferably from 0 to 10% by mass, more preferably from 0 to 5% by mass, further preferably from 0 to 2% by mass, and still further preferably from 0 to 1% by mass, based on the total amount (100% by mass) of the lubricating oil composition.

In general, a commercially available viscosity index improver is often distributed in a form diluted with a diluent oil (such as a mineral oil or a synthetic oil) in consideration of the handleability and the solubility to a base oil, and the content of the viscosity index improver described above means the content in terms of resin content except for the diluent oil. The term "resin content" herein means a polymer that has a number average molecular weight (Mn) of 1,000 or more and a certain repeating unit.

Production Method of Lubricating Oil Composition

The lubricating oil composition of one embodiment of the present invention can be produced by blending the base oil (A) containing the compound (A1) with the polyalkylene glycol (B).

As described in the foregoing, the base oil (A) may further contain the compound (A2) and a synthetic oil other than the compounds (A1) and (A2).

The aforementioned additive for a lubricating oil may be blended along with the polyalkylene glycol (B).

The blending amounts of the respective components have been described in the foregoing.

After blending the components, the components are preferably stirred by a known method and dispersed uniformly.

The technical concept of the present invention encompasses a lubricating oil composition that is obtained through modification of a part of the components or reaction of two components with each other, so as to form another component, after blending the components.

Properties of Lubricating Oil Composition

The density at 15° C. of the lubricating oil composition of one embodiment of the present invention is preferably 1.100 g/cm$^3$ or more, and more preferably 1.105 g/cm$^3$ or more. When the density is 1.100 g/cm$^3$ or more, the lubricating oil composition can be expected to have a high bulk modulus.

The density at 15° C. of the lubricating oil composition of one embodiment of the present invention is generally 1.250 g/cm$^3$ or less.

The kinematic viscosity at 40° C. of the lubricating oil composition of one embodiment of the present invention is preferably from 10 to 150 mm$^2$/s, more preferably from 25 to 70 mm$^2$/s, and further preferably from 25 to 55 mm$^2$/s.

When the kinematic viscosity is in the range, the lubricating oil composition may have appropriate flowability and may not undergo, for example, leakage from a sealed portion and increase of the consumption energy.

The viscosity index of the lubricating oil composition of one embodiment of the present invention is preferably 120 or more, more preferably 130 or more, and further preferably 140 or more.

When the viscosity index is 120 or more, the temperature dependency of the viscosity may become low, and the resulting lubricating oil composition may be favorably used as a lubricating oil.

The rate of kinematic viscosity decrease at 40° C. of the lubricating oil composition of one embodiment of the present invention measured according to JPI-5S-29-88 is preferably 7.0% or less, more preferably 5.0% or less, and further preferably 3.0% or less.

The rate of kinematic viscosity decrease at 100° C. of the lubricating oil composition of one embodiment of the present invention measured according to JPI-5S-29-88 is preferably 7.0% or less, more preferably 5.0% or less, and further preferably 3.0% or less.

Applications of Lubricating Oil Composition

According to the present invention, a lubricating oil composition that has a high density (i.e., a high bulk modulus), a high viscosity index, and excellent shear stability can be provided.

Accordingly, the lubricating oil composition of one embodiment of the present invention is preferably used in any of a hydraulic equipment (such as a construction machine, an injection molding machine, a pressing machine, a crane, a machining center, a hydraulic continuously variable transmission, a robot, a machine tool, a hydraulic circuit of a hydraulic equipment, a servo hydraulic control circuit, a damper, a shock absorber, a brake system, a power steering, and a rolling machine), a rotating equipment (such as a pump and a compressor), a bearing system (such as a hydrostatic bearing, a plain bearing, and a rolling bearing), and a gear (such as a spur gear, a bevel gear, and a worm gear). In particular, the lubricating oil composition of one embodiment of the present invention has a high bulk modulus, a high viscosity index, and excellent shear stability, and thus can be favorably applied to the aforementioned hydraulic equipments.

The lubricating oil composition of one embodiment of the present invention has a high density and a high bulk modulus, and thus particularly exhibits the following high-pressure hydraulic performances.

(1) Energy saving can be achieved due to the low energy loss on compression of the lubricating oil.

(2) Speeding up of a hydraulic circuit can be achieved due to the excellent responsivity in hydraulic pressure.

(3) High precision of a hydraulic control can be achieved due to the excellent stability in hydraulic pressure.

Furthermore, the following low-pressure hydraulic performances can also be exhibited due to the high density.

(4) The difference in dissolved gas concentration between under increased pressure and under atmospheric pressure is small, so as to prevent bubbles from being formed in a reservoir tank, and thus the decrease in hydraulic performance due to the influence of bubbles is considerably small.

(5) The difference in specific gravity between bubbles and the lubricating oil is large, so as to increase the rate of bubble separation in a reservoir tank, and thus the decrease in hydraulic performance due to the influence of bubbles is considerably small.

(6) The solubility of air in the lubricating oil composition of one embodiment of the present invention is smaller by approximately one order of magnitude than the solubility of air in a mineral oil, so as to have a small dissolved gas amount, and thus cavitation hardly occurs, and erosion hardly occurs (prolonging lifetimes of hydraulic valve and pump).

EXAMPLES

The present invention will be described more specifically with reference to examples, but the present invention is not limited to the examples.

Evaluation of Properties and Performances (1) Number Average Molecular Weight (Mn)

The number average molecular weight was measured by GPC (gel permeation chromatography) method as the standard polystyrene conversion. Specifically, the measurement was performed with the following equipment under the following conditions.

GPC equipment: Waters 1515 Isocratic HPLC Pump and Waters 2414 Refractive Index Detector (all produced by Waters Corporation)

Columns: two columns of TSKgel SuperMultipore HZ-M (produced by Tosoh Corporation) connected to each other Column temperature: 40° C.

Eluent: tetrahydrofuran

Flow rate: 0.35 mL/min

Detector: refractive index detector (2) Viscosity at 25° C.

The viscosity was measured according to JIS K7117-1: 1999.

(3) Kinematic Viscosity at 40° C. or 100° C.

The kinematic viscosity was measured according to JIS K2283:2000 (ASTM D445).

(4) Viscosity Index

The viscosity index was measured according to JIS K2283:2000 (ASTM D445).

(5) Density at 15° C.

The density was measured according to JIS K2249-1: 2011.

(6) Ultrasonic Shear Stability

A test was performed according to JPI-5S-29-88 (Method A, ultrasonic irradiation time: 30 minutes, specimen amount: 30 mL), and the rate (%) of the kinematic viscosity decrease was calculated from the kinematic viscosity at 40° C. and 100° C. after the test.

Base Oil and Additives

Base Oil (a-1): Polyethylene glycol dibenzoate shown by the following formula (wherein r is approximately 4, and Mn is 400), kinematic viscosity at 40° C.: 34.1 $mm^2/s$, viscosity index: 66, density at 15° C.: 1.168 $g/cm^3$

[Chem. 4]

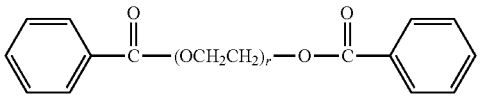

(a-2): Bis(2-(2-butoxyethoxy)ethyl) adipate represented by the following formula (adipate diester of diethylene glycol monobutyl ether), kinematic viscosity at 40° C.: 11.43 $mm^2/s$, viscosity index: 157, density at 15° C.: 1.0256 $g/cm^3$

[Chem. 5]

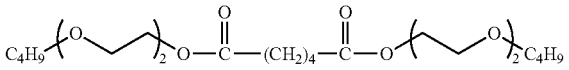

(b-3): "Parapet LW1000", a trade name, produced by Kuraray Co., Ltd., polymethyl methacrylate (Mn: 35,000, solid state at 25° C.)

The content of the compound (b-3) in Table 1 shows the blending amount of the polymethyl methacrylate as a resin component.

(b-4): "30110304", a trade number, produced by General Science Corporation, polyethyl methacrylate (Mn: 250,000, solid state at 25° C.)

The content of the compound (b-4) in Table 1 shows the blending amount of the polyethyl methacrylate as a resin component.

Examples 1 to 3 and Comparative Examples 1 to 3

In Examples 1 to 3 and Comparative Examples 2 and 3, any of the compounds (b-1) to (b-4) was blended in the amount shown in Table 1 (i.e., the amount of the effective component (resin component) except for the diluent) with the base oil (A) containing the compounds (a-1) and (a-2) in the content ratio shown in Table 1, thereby providing lubricating oil compositions (A) to (C), (E), and (F).

In Comparative Example 1, a lubricating oil composition (D) containing only the base oil (A) containing the compounds (a-1) and (a-2) in the content ratio shown in Table 1 was prepared.

The lubricating oil compositions (A) to (F) thus prepared each were measured for the kinematic viscosity at 40° C. and 100° C., the viscosity index, the density at 15° C., and the ultrasonic shear stability (i.e., the rate of the kinematic viscosity decrease at 40° C. and 100° C.). The results are shown in Table 1.

TABLE 1

| | | | | Example 1 | Example 2 | Example 3 | Comparative Example 1 | Comparative Example 2 | Comparative Example 3 |
|---|---|---|---|---|---|---|---|---|---|
| | Lubricating oil composition | | | (A) | (B) | (C) | (D) | (E) | (F) |
| Composition | Base oil | (a-1) | % by mass | 61.13 | 75.40 | 77.42 | 60.27 | 58.67 | 59.67 |
| | | (a-2) | % by mass | 33.87 | 17.60 | 18.08 | 39.73 | 38.33 | 39.33 |
| | Viscosity index improver | (b-1) | % by mass | 5.00 | 7.00 | — | — | — | — |
| | | (b-2) | % by mass | — | — | 4.50 | — | — | — |
| | | (b-3) | % by mass | — | — | — | — | 3.00 | — |
| | | (b-4) | % by mass | — | — | — | — | — | 1.00 |
| Properties | Kinematic viscosity at 40° C. | | $mm^2/s$ | 32.83 | 47.58 | 43.42 | 19.36 | 35.81 | 33.38 |
| | Kinematic viscosity at 100° C. | | $mm^2/s$ | 6.455 | 8.347 | 7.666 | 4.014 | 6.743 | 6.991 |
| | Viscosity index | | — | 154 | 152 | 146 | 104 | 148 | 178 |
| | Density at 15° C. | | $g/cm^3$ | 1.1079 | 1.1288 | 1.1322 | 1.1073 | 1.1115 | 1.1086 |
| | Ultrasonic shear stability | Rate of kinematic viscosity decrease (40° C.) | % | 1.1 | 1.4 | 1.9 | −0.3 | 9.2 | 29.0 |
| | | Rate of kinematic viscosity decrease (100° C.) | % | −0.6 | 1.3 | 1.7 | −0.3 | 8.8 | 30.4 |

Additives (b-1): "Preminol S 3015", a trade name, produced by Asahi Glass Co., Ltd., trifunctional polyoxypropylene glycol (Mn: 15,000, viscosity at 25° C.: 6,300 mPa·s, a compound represented by the general formula (b1), wherein $R^1$ is a trivalent hydrocarbon group, $R^2$ is a propylene group, $R^3$ is a hydrogen atom, a is a number of 1 or more, and b is 3)

(b-2): "Preminol S 4318F", a trade name, produced by Asahi Glass Co., Ltd., bifunctional polyoxypropylene glycol (Mn: 18,000, viscosity at 25° C.: 20,000 mPa·s, a compound represented by the general formula (b1), wherein $R^1$ is a divalent hydrocarbon group, $R^2$ is a propylene group, $R^3$ is a hydrogen atom, a is a number of 1 or more, and b is 2)

The lubricating oil compositions (A) to (C) prepared in Examples 1 to 3 each have a high viscosity index and excellent shear stability. The lubricating oil compositions (A) to (C) each have a high density of 1.100 $g/cm^3$ or more at 15° C. and are considered to have a high bulk modulus.

In contrast to these lubricating oil compositions, the lubricating oil composition (D) prepared in Comparative Example 1 has a low viscosity index and has a problem in lubricating performance. The lubricating oil compositions (E) and (F) prepared in Comparative Examples 2 and 3 each have low shear stability.

INDUSTRIAL APPLICABILITY

The lubricating oil composition of the present invention has a high density (i.e., a high bulk modulus), a high viscosity index, and excellent shear stability. Accordingly, the lubricating oil composition of one embodiment of the present invention can be favorably applied, for example, to various equipments including a hydraulic equipment, a rotating equipment, a bearing system, and a gear.

The invention claimed is:

1. A lubricating oil composition prepared by blending a base oil (A) with a polyalkylene glycol (B), wherein:

the base oil (A) comprises a compound (A 1) that is an ester or ether and has two or more aromatic rings;

a content of the polyalkylene glycol (B) is from 0.2 to 15% by mass based on a total amount of the lubricating oil composition;

the polyalkylene glycol (B) has a number average molecular weight ranging from 10,000 to 60,000; and the lubricating oil composition does not contain a poly (meth)acrylate.

2. The lubricating oil composition according to claim 1, wherein the polyalkylene glycol (B) has a number average molecular weight of from 10,000 to 40,000.

3. The lubricating oil composition according to claim 1, wherein a content of the polyalkylene glycol (B) is from 0.2 to 12% by mass based on a total amount of the lubricating oil composition.

4. The lubricating oil composition according to claim 1, wherein the polyalkylene glycol (B) is a compound represented by the following general formula (b1):

$$R^1—((OR^2)_a—OR^3)_b \quad (b1),$$

wherein:

$R^1$ represents a hydrogen atom, a monovalent hydrocarbon group having from 1 to 10 carbon atoms, an acyl group having from 2 to 10 carbon atoms, a divalent to hexavalent hydrocarbon group having from 1 to 10 carbon atoms, or a monovalent to hexavalent heterocyclic group having from 3 to 10 ring atoms;

$R^2$ represents an alkylene group having from 2 to 4 carbon atoms;

$R^3$ represents a hydrogen atom, a monovalent hydrocarbon group having from 1 to 10 carbon atoms, an acyl group having from 2 to 10 carbon atoms, or a monovalent heterocyclic group having from 3 to 10 ring atoms;

b represents an integer of from 1 to 6; and a represents a number of 1 or more, provided that where plural groups are present for each of $R^2$ and $R^3$, the plural groups for each of $R^2$ and $R^3$ may be the same as or different from each other.

5. The lubricating oil composition according to claim 4, wherein in the general formula (b1), b is 2 or 3.

6. The lubricating oil composition according to claim 1, wherein at least one of aromatic rings in the compound (A1) is a terminal aromatic ring at the end of the molecule.

7. The lubricating oil composition according to claim 1, wherein the compound (A1) is a compound represented by the following general formula (a11):

(a11)

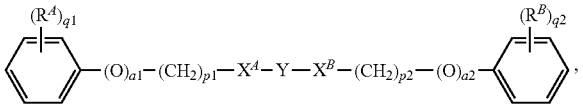

wherein:

$R^A$ and $R^B$ each independently represent an alkyl group having from 1 to 30 carbon atoms, a cycloalkyl group having from 3 to 12 ring carbon atoms, an aryl group having from 6 to 12 ring carbon atoms, an alkyloxycarbonyl group having from 2 to 30 carbon atoms, or an alkylcarbonyloxy group having from 2 to 30 carbon atoms;

$X^A$ and $X^B$ each independently represent a single bond, —O—, —C(═O)—, —C(═O)—O—, or —O—C(═O)—, provided that $X^A$ and $X^B$ do not simultaneously represent single bonds;

Y represents an alkylene group or a (poly)oxyalkylene group;

a1 and a2 each independently represent 0 or 1;

p1 and p2 each independently represent an integer of from 0 to 3; and q1 and q2 each independently represent an integer of from 0 to 5.

8. The lubricating oil composition according to claim 7, wherein the compound (A1) is a compound represented by the following general formula (a13):

(a13)

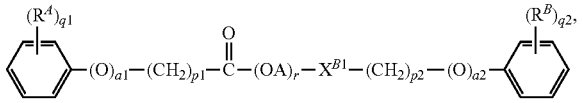

wherein:

$X^{B1}$ represents a single bond, —O—, or —O—C(═O)—;

A represents an alkylene group having from 2 to 4 carbon atoms; and r represents a number of 1 or more.

9. The lubricating oil composition according to claim 1, wherein the base oil (A) further comprises a compound (A2) that is an ester or ether and has no aromatic ring.

10. The lubricating oil composition according to claim 9, wherein a content ratio ((A1)/(A2)) of the compound (A1) and the compound (A2) contained in the base oil (A) is from 1/1 to 10/1 in terms of mass ratio.

11. The lubricating oil composition according to claim 1, wherein a blending amount of the compound (A1) is 30% by mass or more based on the total amount of the lubricating oil composition.

12. The lubricating oil composition according to claim 1, having a density at 15° C. of 1.100 g/cm$^3$ or more.

13. The lubricating oil composition according to claim 1, having a kinematic viscosity at 40° C. of from 10 to 150 mm$^2$/s.

14. The lubricating oil composition according to claim 1, having a viscosity index of 120 or more.

15. The lubricating oil composition according to claim 1, which is adapted to function as a lubricating oil suitable for an application selected from the group consisting of a hydraulic equipment, a rotating equipment, a bearing system, and a gear.

* * * * *